United States Patent [19]

Weigel

[11] Patent Number: 4,940,265

[45] Date of Patent: Jul. 10, 1990

[54] WIREGATE CLOSER

[76] Inventor: Albinus A. Weigel, 1412 E. 8th St., Hays, Kans. 67601

[21] Appl. No.: 424,988

[22] Filed: Oct. 23, 1989

[51] Int. Cl.[5] ..... E05C 19/14

[52] U.S. Cl. ..... 292/113; 292/247

[58] Field of Search ..... 292/247, 113, 248, 106, 292/66

[56] References Cited

U.S. PATENT DOCUMENTS

| | | | |
|---|---|---|---|
| 504,863 | 9/1893 | Carraner | 292/113 |
| 611,741 | 10/1898 | Schlapbach | 292/113 |
| 753,175 | 2/1904 | Stange . | |
| 754,357 | 3/1904 | Spencer | 292/247 |
| 829,007 | 8/1906 | Gilbert | 292/113 |
| 915,511 | 3/1909 | Van Newkirk | 292/247 |
| 925,874 | 6/1909 | Dailey | 292/113 |
| 996,368 | 6/1911 | Ryckmon | 292/113 |
| 1,032,883 | 7/1912 | Croyle | 292/113 |
| 1,035,505 | 8/1912 | Williams . | |
| 1,046,929 | 12/1912 | Adams | 292/247 |
| 1,063,151 | 5/1913 | Wiltse . | |
| 1,212,988 | 1/1917 | Murray | 292/113 |
| 1,261,365 | 4/1918 | Cummings | 292/247 |
| 1,307,650 | 6/1919 | Wilson . | |
| 1,391,578 | 9/1921 | Powell | 292/247 |
| 1,456,143 | 5/1923 | Ness . | |
| 1,458,664 | 6/1923 | Schaefer . | |
| 1,486,905 | 3/1924 | Klingbeil | 292/113 X |
| 2,575,947 | 11/1951 | Etnyre . | |
| 2,613,972 | 10/1952 | Gifford | 292/247 |
| 3,391,254 | 6/1975 | Lile | 292/247 X |
| 3,450,187 | 6/1969 | Fultz | 292/247 X |
| 3,667,729 | 6/1972 | Hinkel . | |
| 3,893,724 | 7/1975 | Reinfeld | 292/247 |

FOREIGN PATENT DOCUMENTS

| | | | |
|---|---|---|---|
| 543175 | 7/1957 | Canada | 292/247 |
| 548227 | 11/1957 | Canada | 292/247 |
| 153734 | 3/1956 | Sweden | 292/247 |

*Primary Examiner*—Eric K. Nicholson

*Attorney, Agent, or Firm*—Kenneth W. Iiles; D. A. N. Chase

[57] ABSTRACT

A wiregate closer comprising an elongated handle welded to a pivot bar having a fulcrum pivotably attached to an anchor post and a second axis of rotation offset from the fulcrum about which a latching strap having a hook on the end rotates to open and close wiregates with significant mechanical advantage is disclosed.

11 Claims, 2 Drawing Sheets

WIREGATE CLOSER

BACKGROUND OF THE INVENTION

1. Field of the Invention.

The present invention is directed to a device for closing wiregates. More particularly, the present invention is directed to a wiregate closer that pulls a wiregate taut with less effort.

2. Description of the Related Art.

Wiregates typically consist of a vertical post loosely bound to the anchor post of a fence by bands that encircle both posts and a number of strands of wire that run to a second wiregate post similarly attached to a second anchor post (see FIG. 1). This second post, or gate post, is not fastened permanently to the adjoining anchor post. Rather, it is held upright, parallel, and adjacent to the second anchor post by a looped band at the bottom and a removable band looped over the tops of both the gate post and the anchor post. When the two bands are in place the wire strands of the wiregate are taut and prevent convenient use of the gate path. The top band is removed from the anchor post or the adjacent gate post by lifting it over the top of the post, removing the lower band from the gate post and carrying the free end of the gate to the bound end, thereby opening the wiregate.

Re-attaching the gate post loop when closing the gate can be very difficult because substantial force is required to hold the wire strands taut.

Wiregates are popular because they are inexpensive to build and maintain. For example, they do not sag as suspended gates are prone to do. In addition, they do not apply as much force to the anchor posts as a suspended gate does, and so the anchor posts require less reinforcement.

The prior art reveals many efforts to reduce the effort required to close and secure a wiregate. One such device is disclosed in U.S. Pat. No. 1,035,505 to Williams, in which a curved hook portion of a handle pivots around a bolt in the anchor post and is attached to an arm that is indirectly hooked onto the gate post. When the arm is drawn toward the anchor post, the hook draws the gate post toward the anchor post. This device requires a separate hook in the gate post and it must be mounted on the top of the anchor post, thereby requiring an anchor post of exactly the appropriate height. This may well require devising a custom-made anchor post and makes retrofitting of this fastener more difficult.

Another approach to this problem is found in U.S. Pat. No. 753,175 to Stang, which discloses a complex wiregate fastener that includes an inner stirrup designed to be bolted through the gate post. This leaves the large, heavy, and unwieldy wiregate fastener attached to the wiregate, which cannot then be allowed simply to fall on the ground, but must carefully be laid on the ground to prevent damaging it. The weight of the wiregate closer added to the wiregate increases the difficulty of opening and closing the wiregate. In addition, the device employs a bale that must be slipped over the top of an adjacent anchor post. This requires that both the gate post and the anchor post be of the proper height and proper width. Otherwise, the device cannot be used.

Another approach in solving the often difficult chore of fastening a wiregate is disclosed in U.S. Pat. No. 3,667,729 to Hinkel, which shows an elaborate handle mechanism fixed to the anchor post having a hook attached to an arm projecting radially outward from the handle shaft. A chain is connected to the hook and to an eyelet screwed into the gate post. When the handles are pushed down, the arm draws the movable gate post toward the anchor post. This device, however, requires that the anchor post be of a specific pre-determined height because the anchor chain must pass over the top of the anchor post. In addition, the device has many parts, making it less reliable and more expensive.

Therefore, a need exists for a wiregate closer that is easier to use; that can be used with anchor posts and gate posts of any height; that can be installed in any of a number of convenient configurations, such as upside down; that can be conveniently installed in any desired position along the height of the anchor post; that has fewer parts and is less expensive and more reliable than wiregate closers in the prior art; that affords the user significant mechanical advantage in drawing up the gate post to the anchor post; that eliminates the need to pass a loop or chain over the top of the gate post or anchor post; that draws the wiregate up tightly to prevent animals from escaping.

SUMMARY OF THE INVENTION

Accordingly, it is a primary object of the present invention to provide a wiregate closer that is easier to use.

It is a further object of the present invention to provide a wiregate closer that can be used with anchor posts or gate posts of any height.

It is a further object of the present invention to provide a wiregate closer that can be readily mounted in a number of different configurations, such as upside down, or on either side of a wiregate or fence.

It is a further object of the present invention to provide a wiregate closer that can be installed at any height along the anchor post.

It is a further object of the present invention to provide a wiregate closer that has fewer parts and is simpler and therefore more reliable and less expensive to manufacture than wiregate closers of the present art.

It is a further object of the present invention to provide a wiregate closer that affords the user a significant mechanical advantage in drawing up the gate post to the anchor post.

It is a further object of the present invention to provide a wiregate closer that eliminates the need to pass a loop or chain over the top of the gate post or the anchor post.

It is a further object of the present invention to provide a wiregate closer that draws the wiregate up tightly to the anchor post to prevent animals from escaping.

These and other objects of the present invention are achieved by providing a wiregate closer comprising a pivot bar, a handle fixed to the pivot bar and a strap pivotably attached to the pivot bar near the first end of the strap and terminating in a hook at the other end. The wiregate closer includes a fulcrum further comprising an aperture pivotably attached to an anchor post of the fence by a bolt or rivet about which the wiregate closer rotates. The fulcrum is located near the first end of the pivot bar, which also includes a pivot point near the second end of the pivot bar to which the strap is attached.

The handle is fixed to the pivot bar adjacent to the pivot point of the pivot bar. The strap is pivotably attached through the pivot point aperture of the pivot bar. This provides for two axes of rotation, the fulcrum about which the entire apparatus pivots and the pivot point about which the strap rotates relative to the pivot bar. The distance between these two axes of rotation provides additional mechanical advantage in closing a wiregate using the wiregate closer, which, when combined with the significant leverage afforded by the handle itself, provides the user with the ability to exert substantial tensioning forces on the wires of the wiregate with minimal exertion.

The three primary parts, that is, the handle, the pivot bar, and the strap are preferably made from carbon steel or other tough metal that will not bend readily so that the hook at the end of the strap will not become straightened through use. The metal is preferably bar stock having a width significantly greater than its thickness.

The handle is preferably welded to the pivot bar and lies in the same plane as the pivot bar.

The wiregate closer may be installed with the handle projecting either upward from the horizontal or downward from the horizontal when the gate closer is in the open position, that is, either right side up or upside down.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
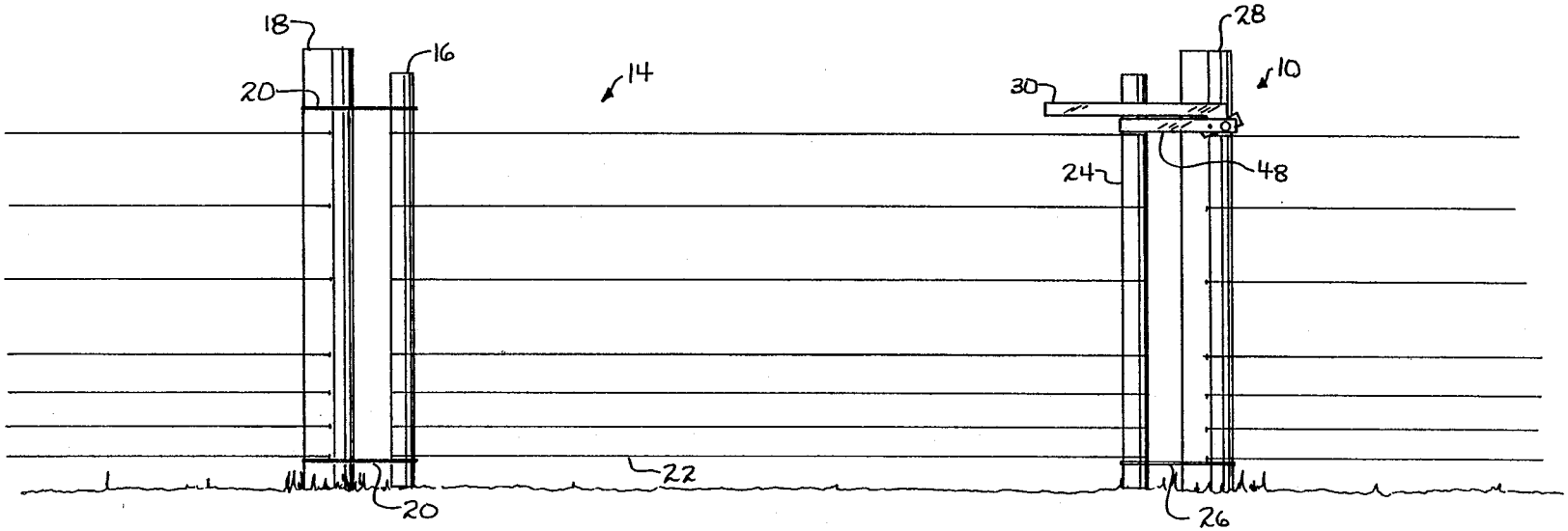
FIG. 1 is a front elevation of a wiregate closer according to the present invention shown in use on a wire fence having a wiregate.

Referring to FIG. 1, there is shown a front elevation of the wiregate closer 10 in the closed position in use on a wire fence 12 having a wiregate 14. The wiregate 14 consists of the gate post 16, which is secured to the left hand anchor post 18 by two bands 20, which may be steel, rope, chains, or the like. In use, it is not intended that these bands will be removed. The wiregate 14 further comprises a number of strands of wire 22, which may be barbed, woven, chain-link, or other wire fencing, stretched to the other gate post 24. Naturally, the barbed wire 22 or other fencing material is firmly fixed to both gate posts 16 and 24 by means of staples or the like. A lower band 26 is fastened around the right-hand anchor post 28 and the right-hand gate post 24. The lower band 26 may be of the same material and construction as the bands 20.

When the wiregate 14 is open, the gate post 24 may be allowed to lie on the ground adjacent to the left-hand anchor post 28, or may be moved entirely out the way.

Figure 2:
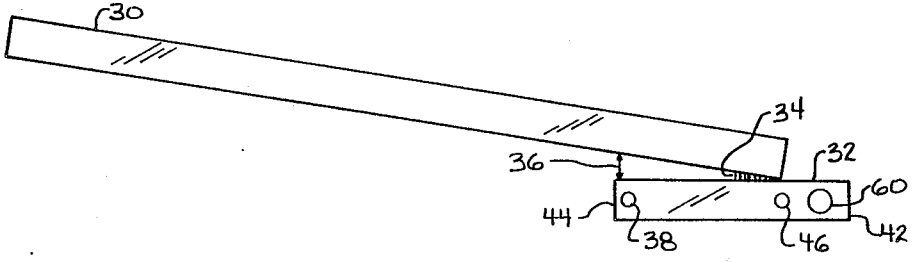
FIG. 2 is a front elevation of the handle and pivot bar assembly of the wiregate closer.

Referring to FIG. 2, there is shown a front elevation of the handle 30 and the pivot bar 32, which are conveniently made of two separate pieces of carbon steel fixed together in the position shown by weld bead 34. Alternatively, the handle 30 and pivot bar 32 assembly could be stamped from heavy sheet metal.

The handle 30 and the pivot bar 32 lie in the same plane, which will be generally a vertical plane when the wiregate closer is installed. The angle 36 between the handle and the pivot bar may be any desired angle although an angle of from about five degrees to fifteen degrees is preferred to facilitate easy use.

Still referring to FIG. 2, there is shown the fulcrum aperture 38 through which the wiregate closer 10 is attached to the anchor post 28 by a bolt or lag screw 40 that penetrates the anchor post 28. As will become apparent in the later figures, the entire wiregate closer 10 rotates about the fulcrum 38. Intermediate of the first end 42 of the pivot bar 32 and the second end 44 of the pivot bar 32 lies the pivot aperture 46, about which the strap 48 rotates.

Thus, the wiregate closer includes two axes of rotation about which the wiregate closer 10 or its components rotate when opening or closing the wiregate closer. These axes of rotation are the fulcrum 38 and the pivot aperture 46.

The handle 30 and the pivot bar 32 are made of separate pieces primarily to ensure that the handle 30 will clear the strap 48 when the wiregate closer is closed and the strap 30 is horizontal. The handle 30 could, for example, be a continuation of the pivot bar 32, but it would then strike the strap 48 during the closing stroke before the pivot aperture 46 was at the maximum distance from the gate post 24. This would cause the wiregate 14 to have more slack than necessary and does not take full advantage of the mechanical advantage and tensioning ability of the wiregate closer.

The mechanical advantage obtained is a function of the length of the handle 30, which may advantageously be about twenty-one inches to twenty-four inches long, and the pivot bar 32 would then be about seven and one-half to eight and one-half inches long, with the fulcrum aperture 38 and pivot aperture 46 being about four inches apart on centers and each having a diameter of about three-eights of an inch.

Figure 3:
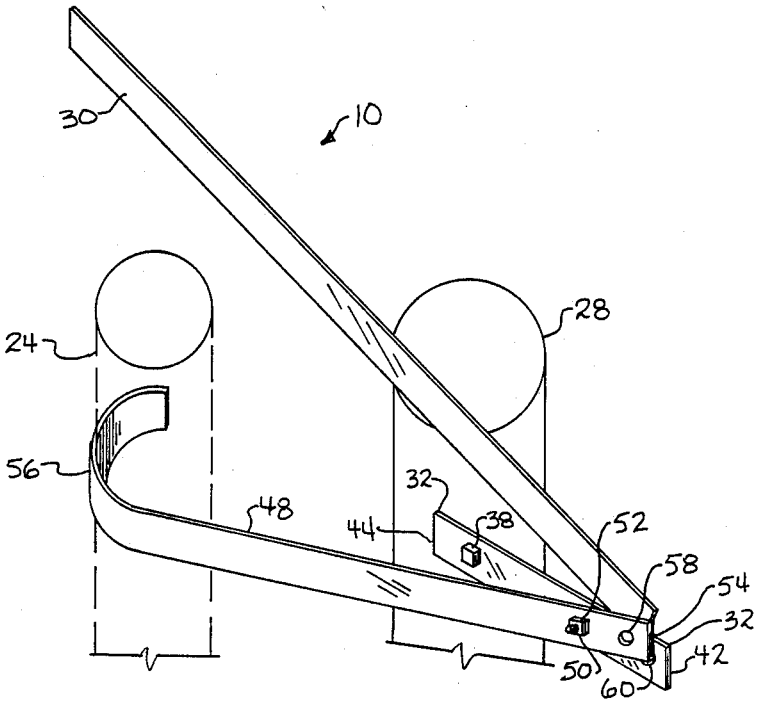
FIG. 3 is a front elevation of the wiregate closer in the starting position for closing the gate.

Referring to FIG. 3, there is shown the wiregate closer 10 attached to the anchor post 28 and beginning to draw up the ghost image gate post 24. Clearly visible is the strap 48 having a first end including an aperture 50 pivotably fixed to the pivot bar 32 by nut and bolt 52. The aperture 50 is located near the first end 54 of the latching strap 48. The other end of the latching strap 48 terminates in a hook 56, which is bent from the straight strap material itself into an essentially semi-circular arc having a diameter of approximately four and one-half inches.

Figure 5:
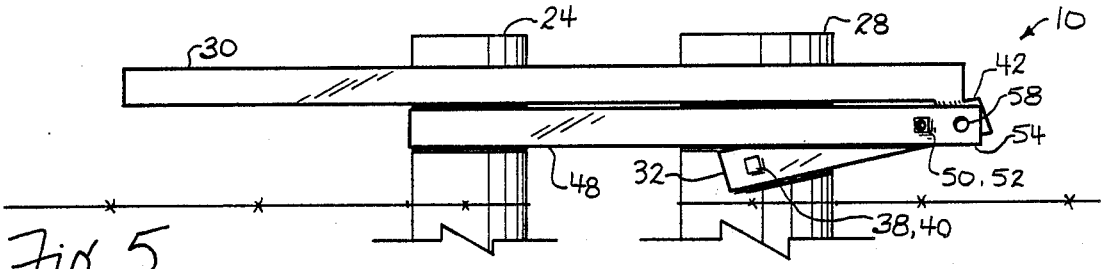
FIG. 5 is a front elevation of the wiregate closer on a wiregate in the closed position.
Figure 4:
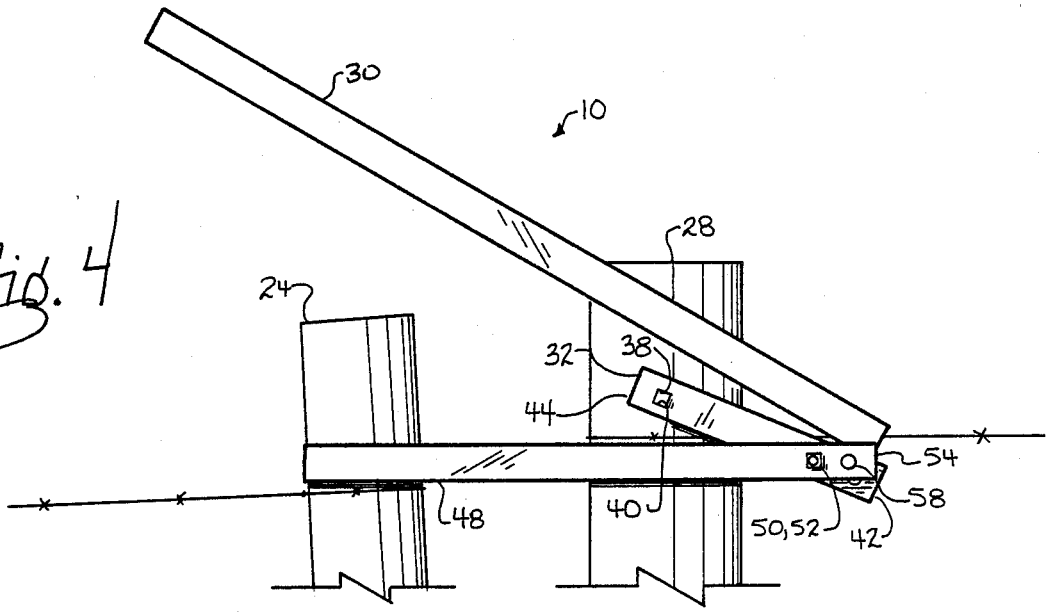
FIG. 4 is a front elevation of the wiregate closer in an intermediate stage of the closing cycle.

In operation, the wiregate closer allows for a maximum horizontal movement of eight inches by the gate hook 56, that is four inches to the left of the anchor post 28 and four inches to the right of the anchor post 28 as shown in FIG. 3 because the connecting point of the latching strap 48 is about four inches from the fulcrum 38. This allows the gate post 24 to be brought up toward the anchor post 28 by hand up to about eight inches away from the anchor post 28, an operation that requires little force because the wire in the wiregate is not taut. Then, the handle 30 is rotated downward as illustrated in figures gradually swinging the second axis of rotation, that is about aperture 50, away from the gate post as is progressively illustrated in FIGS. 3, 4, and 5. When the handle 30 of the wiregate closer is essentially horizontal, as illustrated in FIG. 5, the wiregate closer 10 is closed and the gate post 24 is held tightly adjacent to the anchor post 28. In that position, the locking aperture 58 in the latching strap 48 aligns with the locking aperture 60 in the pivot bar 32. A lock or latch pin can be inserted through these aligned locking apertures to prevent unauthorized operation of the wiregate closer 10.

In addition, the wiregate closer 10 can be mounted upside down, that is, so that the handle 30 rotates in an arc below the horizontal to close the wiregate closer 10. This installation method may be preferred when the gate will be used by children who may be unable to reach the handle 30 conveniently otherwise. When the wiregate closer 10 is mounted upside down, the aligned locking apertures 58, 60 allow insertion of a pin or other keeper that will prevent the handle from falling down and thereby loosening the wiregate 14 inadvertently.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A wiregate closer comprising:
(a) a pivot bar;
(b) a separate handle having two ends, said handle being fixed at one of said ends to said pivot bar, said handle and said pivot bar lying in the same plane and said handle being disposed at an upward angle of from about 5 degrees to about 15 degrees relative to said pivot bar, whereby said handle is above said pivot bar; and
(c) a strap pivotably attached to said pivot bar near a first end of said strap and terminating in a hook at the other end.

2. A wiregate closer claimed in claim 1 wherein said pivot bar further comprises a fulcrum near the first end of said pivot bar and a pivot point near the second end of said pivot bar.

3. A wiregate closer as claimed in claim 2 wherein one said end of said handle is fixed to said pivot bar at a location between said pivot point and said first end of said pivot bar.

4. A wiregate closer claimed in claim 3 further comprising a first aperture in said pivot bar between said pivot point and said second end of said pivot bar and a second aperture located in said strap, between said pivot point and said first end of said strap, with said first and second apertures being aligned when said wiregate closer is in a closed position.

5. A wiregate closer claimed in claim 4 wherein said strap, said pivot bar and said handle are made from carbon steel.

6. A wiregate closer claimed in claim 5 wherein said handle is welded to said pivot bar.

7. A wiregate closer comprising:
(a) a pivot bar having a first end and a second end, a fulcrum aperture near said first end, and a pivot aperture near said second end;
(b) a separate handle fixed to said pivot bar at a location proximate to said pivot aperture, said handle and said pivot bar lying in the same plane, said handle being disposed at an upward angle of from about 5 degrees to about 15 degrees relative to said pivot bar, whereby said handle is above said pivot bar; and
(c) a strap having a first end and a second end, said second end terminating in a hook, said strap further including an aperture proximate to said second end, said strap being pivotally connected to said pivot bar by a fastener through said pivot aperture of said pivot bar and said aperture of said strap.

8. A wiregate closer claimed in claim 7 wherein said strap, said pivot bar and said handle are made of carbon steel bar stock.

9. A wiregate closer claimed in claim 8 wherein said handle is welded to said pivot bar.

10. A wiregate closer claimed in claim 8 further comprising a first latching aperture in said pivot bar intermediate said pivot aperture and said second end of said pivot bar, and a second latching aperture in said strap proximate said first end of said strap, with said first and second latching apertures being aligned when the wiregate closer is in the closed position.

11. A wiregate closer comprising:
(a) a steel pivot bar having a first end and a second end, a fulcrum aperture near said first end, a pivot aperture near said second end, and a pivot bar locking aperture adjacent to said second end;
(b) a separate steel handle welded to said pivot bar at a location proximate to said pivot aperture, said handle and said pivot bar lying in the same plane, said handle being disposed at an upward angle from about 5 degrees to about 15 degrees relative to said pivot bar, whereby said handle is above said pivot bar wherein said wiregate closer is in its normal and closed position; and
(c) a steel latching strap having a first end and a second end, said second end terminating in a semicircular hook, said latching strap having an aperture and a separate locking aperture, said strap being pivotally connected to said pivot bar by a fastener through said pivot aperture of said pivot bar and said aperture of said strap, and a strap locking aperture whereby said wiregate closer may be secured by a locking means inserted into said pivot bar locking aperture and said latching strap locking aperture, which are aligned when said wiregate closer is in a closed position.

* * * * *